United States Patent [19]

Casey

[11] 4,068,671

[45] Jan. 17, 1978

[54] NICOTINE REMOVAL PROCESS

[75] Inventor: William J. Casey, Trumbull, Conn.

[73] Assignee: AMF Incorporated, White Plains, N.Y.

[21] Appl. No.: 599,277

[22] Filed: July 25, 1975

[51] Int. Cl.[2] ..... A24B 15/02

[52] U.S. Cl. ..... 131/143; 131/120; 131/133 R; 131/140 B

[58] Field of Search ..... 131/17 A, 17 R, 17 AC, 131/17 AE, 133 R, 140 R, 140 B, 140 P, 143, 120, 121

[56] References Cited

U.S. PATENT DOCUMENTS

| | | | |
|---|---|---|---|
| 1,551,676 | 9/1925 | McConnell | 131/143 |
| 1,823,554 | 9/1931 | Mewborne | 131/143 |
| 2,117,558 | 5/1938 | Hyatt | 131/143 |
| 2,822,306 | 2/1958 | Thienemann | 131/143 |
| 3,366,126 | 1/1968 | Velez, Sr. | 131/143 |
| 3,398,754 | 8/1968 | Tughan | 131/143 |
| 3,467,109 | 9/1969 | Block et al. | 131/140 C |
| 3,511,843 | 5/1970 | Lewis | 131/143 |
| 3,593,721 | 7/1971 | Knop et al. | 131/140 C |
| 3,628,541 | 12/1971 | Buchmann et al. | 131/140 C |
| 3,860,012 | 1/1974 | Selke | 131/143 |

*Primary Examiner*—Robert W. Michell
*Assistant Examiner*—T. S. Gron
*Attorney, Agent, or Firm*—George W. Price; Charles G. Worth

[57] ABSTRACT

This invention concerns a method of removing nicotine from tobacco by rapid drying of an alkaline aqueous dispersion of tobacco. Preferably, the dried tobacco is remoistened with water and subsequently rapidly redried to realize higher efficiency of nicotine removal.

9 Claims, No Drawings

NICOTINE REMOVAL PROCESS

This invention relates to a method of removing nicotine from tobacco.

Nicotine is an alkaloid which is physiologically active in human hosts and the nicotine of cigarette smoke has been associated with cardiovascular disturbances in cigarette smokers (see: The Health Consequences of Smoking, A Public Health Service Review: 1967).

A number of methods for removing nicotine from tobacco are known, most of these relying on extraction procedures using solvents, including reactive solvent-systems. The most common solvent systems employ water as at least a component, and usually include a basic material to neutralize the nicotine acid salts thus liberating the free base which is soluble in a variety of solvents. In this latter regard, U.S. Pat. No. 2,822,306 describes the removal of nicotine from tobacco by solvent extraction as by the Soxhlet method, or by leaching with large volumes of water, containing basic materials to neutralize the nicotine acid salts contained in natural tobacco, i.e. phosphoric acid salts. As pointed out in the said patent, and as is inherent in any of the solvent extraction or water-leaching methods of removal of nicotine, a considerable amount of tobacco solubles other than nicotine is also removed from the tobacco. These solubles have to be returned to the tobacco in order to preserve the original tobacco taste characteristics, and are so returned after solvent extraction of nicotine from the original extract and after concentration of the extract.

In the usual method of determination of nicotine content of tobacco, the tobacco is suspended in water at high alkaline pH, usually about pH = 11, and the suspension is then steam-distilled to volatilize the free nicotine base, after which U.V. measurement of distillate indicates the nicotine content. Such stream distillation invariably degrades the tobacco, causing blackening and thus renders the tobacco essentially useless for commercial tobacco products.

As is apparent, there is need for a simple and economical method of removing nicotine from tobacco to produce a tobacco of reduced nicotine content without degrading the tobacco, or without necessitating costly and time-consuming extractive procedures which in turn necessitate reconstitution of the tobacco by returning the tobacco solubles other than nicotine to the extracted tobacco.

The present invention provides a simple and economical method of removing nicotine from tobacco at a high level of efficiency using standard processing equipment but without the attendant disadvantages of prior art methods mentioned hereinbefore.

The present inventive process is accomplished by rapidly drying an aqueous dispersion comprising particulate tobacco, the dispersion being at an alkaline pH to volatilize the free nicotine base therefrom. Rapid drying can be accomplished by spray drying of the alkaline aqueous dispersion, or by drying a film or sheet formed from an alkaline aqueous dispersion of tobacco. In general, any of the rapid drying methods predicated on air-convection drying in which at least about 90% of the initial water content is removed within about 2 minutes, and preferably about one minute, can be employed. Such drying methods include the aforementioned spray drying and belt drying, as well as flash drying, kiln drying, cabinet tray and pan drying, fluidized bed drying and air-lift drying.

By "rapid drying" as employed herein, and in the appended claims, is meant drying by air convection in which at least about 90% of the initial water content is removed from the alkaline aqueous suspension of tobacco within about 2 minutes. Of the rapid-drying methods, the preferred are belt drying and spray-drying, and of these, the more preferred is belt-drying because it is highly efficient, most economical and employs apparatus commonly used in processing tobacco.

The film or sheet forming and drying steps of the present process can be accomplished in the same manner as employed in the processing of tobacco into reconstituted tobacco sheet which processing is well-known in the art. Spray drying of the alkaline aqueous dispersion is accomplished by use of standard techniques and equipment commonly employed, especially in food processing.

To improve the efficiency of nicotine removal, the dried tobacco can be re-wetted with water and re-dried to effect further removal of nicotine, with the re-wetting and re-drying steps being repeated until the desired, or optimum, level of nicotine content is reached. When dried in the form of a sheet, as an alternative to the re-wetting and re-drying sequence, the tobacco sheet may be comminuted, re-suspended in water, cast and then dried to accomplish further removal of nicotine than originally effected. As should be obvious to those skilled in the art, the first drying step need not be brought to completion before the re-wetting modification, or the re-slurrying alternative, but can be stopped at any convenient point and re-processing then initiated.

For many purposes, the single stage drying of the tobacco will result in a desirable reduction of the nicotine content, the results usually showing a substantial reduction, e.g. in the preferred belt drying of tobacco sheet, at least about 50%. When the tobacco sheet is further processed in multi-step drying, as by re-slurrying and drying, or re-wetting and re-drying, the efficiency of removal of nicotine increases substantially, with reductions of at least about 70% and higher being attainable. Similar increases are attainable with the other rapid drying methods on repeating the drying after re-wetting.

In multi-step drying, each drying step may be accomplished by the same procedure, e.g. by belt drying, or a combination of drying procedures can be employed. For example, the first drying step can be accomplished by spray-drying and the second step by belt-drying. Since up to the present, belt drying is found to be of a high order of efficiency, it is preferred to use belt drying as the last drying step. Thus, where two drying steps are used, the second is preferably belt drying to ensure high order efficiency of nicotine removal.

In the preferred belt drying, the tobacco dispersion in alkaline water may be cast and dried in essentially the same manner and with the same equipment as employed in the production of reconstituted tobacco sheet. Thus, the tobacco in particulate form is slurried in water conveniently at a solids concentration of about 3–50% preferably at about 5–20%; the pH is adjusted to be alkaline and the slurry is cast on a smooth surface and dried, usually at elevated temperature. The nicotine volatilizes with the water during drying. To form a coherent sheet, it is usually advisable to include a tobacco film-forming agent, e.g. an alkyl cellulose ether, but such film-forming agent is not always required, especially with tobacco that is effectively self-binding, as described, for example, in U.S. Pat. No. 3,464,422 issued Sept. 2, 1969. The use of the film-forming agent is for convenience in the handling of the dried sheet and is not critical to the inventive process.

For spray drying, aqueous dispersions containing tobacco at a solids concentration of up to about 30% are convenient, although even higher concentrations, up to 50% can be employed, but require special handling. For other rapid drying procedures, e.g. flash drying, aqueous dispersions of up to about 30% by weight solids are preferred for ease of handling.

The tobacco employed in the present process is in the particulate form, including chopped stems, leaves and veins of any size, but is preferably in highly comminuted form, e.g. fine mesh size of 20 to 100, and even higher. Larger particle size can be employed but the nicotine removal efficiency may be diminished somewhat. For the preferred belt drying, the ease of casting the dispersion as a continuous sheet using the highly comminuted form of tobacco is well known in the art. The tobacco employed in this process may include fines, dust, leaves, stems, veins, and salvaged tobacco as is commonly employed in making reconstituted tobacco.

The pH of the cast sheet should be maintained alkaline throughout the drying procedure to ensure liberation of the nicotine free base from the acid salt form in which it occurs in tobacco. The maintenance of alkalinity can be accomplished by any of the art-recognized procedures, as by spraying the sheet with aqueous alkali during the drying process, or by use of ammonia gas. It has been found that adjustment of the initial pH of the aqueous tobacco slurry to a value from about 9.0 to about 9.5 will generally ensure maintenance of alkalinity throughout the drying sequence. For best results, the pH of the cast sheet is usually maintained at least at about 8.0 and preferably above 8.5. Of course, the initial nicotine content of the tobacco used in the process will dictate processing controls since the higher the content, the more base will be required. Thus, high nicotine content, up to 7%, in the original tobacco employed will dictate more careful monitoring of the alkalinity whereas intermediate nicotine levels of say 1–3%, which are common to American tobaccos, require less monitoring. Alkali can be added to the cast sheets when they are re-wetted or comminuted and re-slurried prior to re-drying to ensure alkalinity. It is preferred to adjust the pH to the range of 8.5 – 9.5 when so doing. For all purposes, the pH of the sheet is preferably less than 10 so that darkening of the tobacco sheet during drying at elevated temperatures be minimized, or preferably completely avoided.

For the preferred belt drying, it is preferable to cast the alkaline aqueous tobacco dispersion on an endless steel belt, provided with drying means, so that a continuous operation can be realized. Such a belt, and suitable drying means, e.g. steam dryers, are well-known and commonly used in the processing of reconstituted tobacco sheet, and may be conveniently used for the denicotinization process of this invention. The dispersion is usually cast at thicknesses which will result in a dry tobacco sheet of from about 3 to about 10 mil in thickness, preferably 3–8 mils. Generally, such thicknesses will be about 15–25 mils with normal aqueous dispersions and about 30–50 mils with formed aqueous dispersions.

The drying step is conveniently accomplished under ambient pressure by use of elevated temperature sufficient to volatilize the nicotine and water from the cast sheet. As is well-known, tobacco is somewhat heat-sensitive in that the use of elevated temperatures particularly at alkaline pH can result in darkening of the tobacco which should be avoided. To ensure against any appreciable darkening of the tobacco, the temperature is usually maintained below 200° F. and preferably below 195° F. However, as is well-known, darkening can be compensated by the use of dyes or whitening agents, e.g. titanium dioxide, if it should occur. Of course, at pressure less than atmmospheric pressure, lower temperatures can be employed but in continuous processing, the provision of subatmospheric pressure for the drying step is not conveniently implemented and therefore not preferred.

The drying step can be carried out until substantially all water has been removed but this is not always necessary, since some moisture can be retained by the sheet without seriously affecting the efficiency. In any event, the moisture content of the dried sheet may have to be increased to permit facile removal of the sheet from the drying surface, as by use of a doctor blade on a stainless steel belt surface, to obtain a uniform sheet product. The sheet, of course, can be re-wetted to any necessary moisture content for this purpose, e.g. up to about 10–30% moisture for removal by doctor blade, to obtain a sheet of excellent appearance. In continuous processing on an endless stainless steel belt, a belt speed of from about 50–75 feet per minute up to 120 feet per minute is found to provide highly efficient nicotine removal at temperatures of from about 175° -195° F., for dispersions with solids content ranging up to 50%. In a 60 ft. drying system, e.g. steam dryers, the drying time ranges from 30 seconds to one minute at belt speeds of from 120 ft./min. to 60 ft./min.

The film-forming agent to be used in the present process can be any of those employed in the production of reconstituted tobacco sheet. These include gums and adhesives such as the natural gums, e.g. galactomannans such as locust bean gum and guar gum, or their derivatives; plant gums such as algins, carrageenins, laminarins, agar, starches, pectins, and the like, cellulose and derivatives, particularly the ethers, especially methylcellulose, hydroxyethylcellulose, methylhydroxyethylcellulose, etc., and others. The amount of film-forming agent used can be varied considerably but usually falls in the range of from about 0.01% to about 12.0%, preferably from about 0.05 to about 7% based on the weight of tobacco.

For spray-drying, any of the commercially-available spray-dryers can be employed. Thus dryers predicated on counter-current or mixed flow of the alkaline, aqueous tobacco dispersion with the heated air introduced into the dryer can be employed. As is characteristic of such spray dryers, the drying time is invariably a matter of seconds. The tobacco dispersion is introduced into the dryer by conventional means, e.g. by pressure nozzle or centrifugal disk atomization, and exposed to heated air, either mix-flowed with the dispersion or flowed counter-current to the dispersion and drying is almost instantaneous. The dried product collects in the dryer and is removed either continuously or in batch quantities.

For convenience in the operation of the spray dryer, it is usually preferred to use tobacco dispersions of up to about 25–30% solids. If higher solids content is employed, there may be need for special equipment to introduce the dispersion into the dryer since as is well-known, the higher solids content tobacco dispersions are quite viscous. Since little advantage is obtained using the higher solids content, they are not preferred. Usually, lower solids content, e.g. up to 10%, are provided since the amount of water per unit weight of dried tobacco requires substantial heat input with no particular advantage realized over the use of suspensions of solids content of from above 10% to 25–30% solids content. Preferred solids content are from about 20% to about 30%.

To avoid possible darkening of the tobacco, the temperature of the inlet heated air is usually not higher than about 350° F. which results in the temperature of the tobacco not exceeding about 190° F. As is known, the solids in the dispersion remain at lower temperatures due to evaporation effects on the surface resulting in lower temperatures of the tobacco. Higher inlet gas temperatures, e.g. up to 600° f. can be used, however, because the time of exposure of the dispersion to the inlet gas is only a matter of seconds.

In some commercial spray dryers, drying is effected in two stages and such dryers are particularly effective with low solids content dispersions, e.g. below 10%.

As in the preferred belt drying embodiment, spray-drying can be repeated as often as necessary to attain desired nicotine levels. It is usually preferable to complete spray drying by belt drying as the final drying step as mentioned hereinbefore. For most purposes, a single spray drying followed by a belt drying will provide the most practical levels of nicotine removal from the tobacco thus treated.

As in the belt-drying embodiment, it is not essential to dry the tobacco to complete dryness since small amounts of water can be retained in the tobacco without seriously affecting the efficiency of nicotine removal.

In general, the remaining aforementioned rapid drying methods, e.g. flash drying and kiln drying, can be accomplished in much the same manner as spray-drying, using the same considerations of temperature, solids content, and the like as described for spray drying and need not be elaborated on for the purpose of this disclosure since they are within the skill of the art.

The single drying modification of the present invention is most effective in removal of nicotine from tobacco in which the nicotine level is preferably at least 1%. When the nicotine level is less than 1%, especially when less than 0.5%, the efficiency of nicotine removal is somewhat lower. However, the multiple drying step modification can be used effectively with tobaccos of which the nicotine content is less than 1% and even less than 0.5%. The efficiency of such removal is enhanced by repeated re-treatment of wetting and drying and is economically practical because of the simple procedures and apparatus involved.

The final nicotine content of the dried tobacco sheet can be controlled to assume any desired level by controlling the length of time, and thus the degree, of drying of the tobacco; by controlling the original amounts of water present; by controlling the pH; and/or controlling the temperature of the drying step. The proper conditions for ensuring a specific level of nicotine in the resulting tobacco sheet can be readily determined by minimum routine experimentation which can provide the bases for selection of operating conditions on a commercial scale, especially continuous processing.

The final tobacco product obtained from the inventive process retains substantially the entire original constituents, excepting the removed nicotine and other volatiles, and no other significant weight loss is detectable. Any minor differences from original weight are attributable to the loss of volatile tobacco components which, when present, are volatilized during the heating step. The tobacco retains its original characteristics of taste and aroma, the exception being the diminished levels of nicotine in the tobacco smoke as evidenced by the substantially reduced nicotine impact.

Of course, the low nicotine tobacco prepared in accordance with this invention may be blended with untreated or partially treated tobacco if desired. In one such embodiment, tobacco which has been spray dry treated as described herein is blended into a conventional reconstituted tobacco slurry at a 30% level and cast into final products.

In all of the drying modifications described herein, nicotine is volatilized from the tobacco along with water and can be collected by the mere expedient of collecting the volatiles in the environs of the drying equipment employed using art-recognized procedures. The separation of the nicotine from water can be accomplished by known procedures.

The following examples are given to further illustrate the invention. In these examples, all belt drying is effected using a 60 ft. steam box dryer and belt speeds of from 50-120 ft./min., resulting in drying times of 1.2 min. to 0.5 min., respectively.

EXAMPLE 1

A tobacco dispersion is prepared with the following composition:

EXAMPLE 1

| A tobacco dispersion is prepared with the following composition: | |
|---|---|
| Tobacco (Virginia Bright stems and leaves) | 800 g. |
| Methylcellulose (Methocel 15000 cps) | 16 g. |
| Water | 5000 g. |
| NaOH | to pH 9.2–9.3 |

The methylcellulose is added to the water and then the tobacco to obtain a homogeneous slurry. Aqueous NaOH (10%) is added until the pH is 9.2–9.3. The mixture is thoroughly mixed for about 5 minutes and the pH rechecked. The slurry is then cast onto an endless stainless steel belt (50 ft./min. belt speed) and dried at 185° F.

The dried tobacco is rehumidified and removed from the belt with a doctor blade (sample 1). A portion of sample 1 is resuspended in water at 15% solids and cast as a film and redried as above to obtain sample 2. The pH of the resuspended tobacco is 8.5.

Analysis of the dried tobacco samples 1 and 2 for the residual nicotine gives the following results, based on 2 separate nicotine determinations:

TABLE I

| | % Nicotine | | | |
|---|---|---|---|---|
| | 1 | 2 | Ave. | % Reduction |
| Starting Tobacco | 1.54 | 1.40 | 1.47 | — |
| Sample 1 | 0.56 | 0.55 | 0.55 | 62.6 |
| Sample 2 | 0.28 | 0.28 | 0.28 | 80.9 |

EXAMPLE 2

One hundred pounds of tobacco (Virginia Bright, stems and leaves) is ground and suspended in 1545 lbs. of water. The pH is adjusted with sodium hydroxide to pH 9.3. Methylcellulose (0.6 lb.) is added, and after mixing the suspension is cast on an endless stainless steel belt. The material is dried at 185° F. at a belt speed of 50 ft./min. and re-humidified to 30% moisture with steam. A nicotine determination is made on this material (Sample 1). A portion of this tobacco is resuspended in water and the pH again adjusted with sodium hydroxide to pH = 9.3. This suspension is then cast on a belt, dried as above and a nicotine determination made on this material (Sample 2). The results based on two separate nicotine determinations for each Sample are given in Table II.

TABLE II

| | % Nicotine | | | |
|---|---|---|---|---|
| | 1 | 2 | Ave. | % Reduction |
| Starting Tobacco | 1.74 | 1.72 | 1.73 | — |
| Sample 1 | 0.59 | 0.60 | 0.60 | 65.3 |
| Sample 2 | 0.31 | 0.34 | 0.32 | 80.9 |

EXAMPLE 3

One hundred pounds of tobacco is ground and suspended in 1545 lbs. of water. The pH is adjusted with sodium hydroxide to pH 9.5. One pound of methylcellulose is added and after mixing the suspension is cast on an endless stainless steel belt. The material is dried at 185° F. at a belt speed of 60 ft./min., re-humidified to 30% moisture with steam and a nicotine determination made on this material (Sample 1). The remainder of the tobacco is divided into two equal parts and resuspended in water. One part (Sample 2) is readjusted to pH 9.5 with aqueous NaOH. The other part (Sample 3) has a pH of 7.8 and the pH is not adjusted. These suspensions are then separately cast on a belt, dried as above, and nicotine determinations made. The results based on two nicotine determinations for each sample are given in Table III.

TABLE III

| | % Nicotine | | | |
|---|---|---|---|---|
| | 1 | 2 | Ave. | % Reduction |
| Starting Tobacco | 1.74 | 1.72 | 1.72 | — |
| Sample 1 | 0.70 | 0.73 | 0.72 | 58.4 |
| Sample 2 | 0.38 | 0.40 | 0.39 | 77.5 |
| Sample 3 | 0.54 | 0.55 | 0.54 | 68.8 |

EXAMPLE 4

Twenty pounds of tobacco (Wisconsin Broadleaf) is ground and suspended in 86 lbs. of water. The pH is adjusted with sodium hydroxide to pH 9.6. Methylcellulose 0.5 lb., is added and after mixing the suspension is cast on an endless stainless steel belt, dried at 185° F. at a belt speed of 75 ft./min. and re-humidified with steam. The tobacco was resuspended in 80 lbs. of water and the pH again adjusted with sodium hydroxide to pH = 10.0. This suspension is then cast on a belt, dried as above, and nicotine determination made on this material (Sample 1). The results based on two determinations for each Sample are given in Table IV.

TABLE IV

| | % Nicotine | | | |
|---|---|---|---|---|
| | 1 | 2 | Ave. | % Reduction |
| Starting Tobacco | 1.24 | 1.24 | 1.24 | — |
| Sample 1 | 0.25 | 0.24 | 0.25 | 79.8% |

EXAMPLE 5

Eight hundred grams of tobacco are ground and suspended in 5000 grams of water. The mixture is adjusted with sodium hydroxide to pH 9.2. Methylcellulose (16 g.) is added and the suspension is cast on an endless stainless steel belt. Then the material is dried at 185° f. at a belt speed of 120 ft./min., re-humidified with steam, and a nicotine determination made on a sample of this material (Sample 1). The remainder of this tobacco is resuspended in water at 15% solids and the pH again adjusted with sodium hydroxide to pH = 8.5. This suspension was then cast on a belt, dried as above, and nicotine determination made on this material (Sample 2). The results based on two nicotine determinations for each Sample are given in Table V.

TABLE V

| | % Nicotine | | | |
|---|---|---|---|---|
| | 1 | 2 | Ave. | % Reduction |
| Starting Tobacco | 1.54 | 1.40 | 1.47 | — |
| Sample 1 | 0.56 | 0.55 | 0.55 | 62.6 |
| Sample 2 | 0.28 | 0.28 | 0.28 | 80.9 |

EXAMPLE 6

The procedure of Example 1 is repeated except that the initially dried tobacco sheet is not removed from the steel belt and is rehydrated to a moisture content of 50% and again dried to remove additional nicotine.

As an alternative, the rehydrated tobacco sheet is removed from the steel belt and passed onto a porous belt and then dried on the porous belt, on which it can be readily rehydrated and re-dried to remove nicotine.

To further illustrate the advantage of belt drying as the preferred embodiment of this invention, the following example illustrates nicotine removal from a commercial tobacco suspension formulation in water (alkaline) in which the dried, de-nicotinized product is commercial reconstituted tobacco sheet. As is apparent from the example, the removal of nicotine is accomplished in the normal sheet forming step employed in commercial production or reconstituted tobacco, i.e. the tobacco suspension is cast on a steel belt and dried to sheet form. The change over normal production of tobacco sheet is the adjustment of the pH of the tobacco suspension (normally 5.9 to 6.3) to alkaline pH.

EXAMPLE 7

An aqueous dispersion of a reconstituted tobacco formulation (10% solids) is cast on a stainless steel belt and dried at 185° F. at belt speeds of 50–75 ft./min. After re-hymidifying with water and removal from the belt, the tobacco sheet is chopped to dimensions of 2 × 3 inches which is a form readily handled by cigarette manufacturers for production of cigarettes.

The initial tobacco dispersion is selected to produce a final product of the following formulation:

85% Tobacco

6% Wood Cellulose, refined to 200 CSF as described in U.S. Pat. No. 3,125,098

6% Gums (a mixture of methylcellulose, Locust Bean gum and Guar gum in 1:1:1 proportion)

3.0% Base

The nicotine reduction of four different runs are given in Table VI, based on two nicotine determinations for each sample.

TABLE VI

| | % Nicotine 1 | 2 | Ave. | % Reduction |
|---|---|---|---|---|
| A. Control Bright Tobacco | 1.37 | 1.29 | 1.33 | — |
| 1. Sheet 85% Tobacco Slurry pH 7.3 | 0.99 | 0.97 | 0.98 | −13 |
| 2. Sheet 85% Tobacco Slurry pH 8.7 | 0.30 | 0.30 | 0.30 | −73 |
| B. Control Burley Tobacco | 1.99 | 2.07 | 2.03 | — |
| 1. Sheet 85% Tobacco Slurry pH 7.3 | 1.37 | 1.42 | 1.37 | −19 |
| 2. Sheet 85% Tobacco Slurry pH 9.0 | 0.84 | 0.82 | 0.83 | −52 |

When the dried tobacco is reslurried and re-cast and dried, further reduction of the nicotine is realized.

EXAMPLE 8

The procedure of Example 5 is repeated excepting the first stage drying to obtain Sample 1 is effected by use of a conventional spray drying apparatus with inlet heated air at 320° F. and the exhaust air at 170° F. The tobacco suspension is at 20% solids level.

The denicotinized tobacco products of Examples 1-6 and 8 can be formed into commercial reconstituted tobacco sheet by any of the art-recognized procedures. To the denicotinized tobacco there can be added for example, adhesives, humectants, cross-linking agents, wood pulp, colorants, ash-additives, flavorants and the like, to produce a reconstituted tobacco in accordance with the procedures described in U.S. Pat. Nos. 2,769,734; 3,106,212; 3,125,098; 3,584,631; 3,872,871; and 3,821,959.

It may be desirable to lower the pH of the tobacco products of Examples 1-8 to the normal range of the tobacco, i.e. at or near pH 7, or usually slightly lower than 7, especially when the pH of the denicotinized product is above about 8.0 - 8.5. The lowering of the pH can be effected by the use of acids, especially organic carboxylic acids, which do not adversely affect the tobacco or the smoke produced therefrom. A preferred acid for this purpose is citric acid, although a large variety of similar acids, such as tartaric acid, can also be exmployed. The selection of suitable acids is within the skill of the art.

The selected acid can be applied to the alkaline denicotinized tobacco at any convenient point after nicotine removal is accomplished. For example, an aqueous solution of citric acid can be applied to the denicotinized tobacco product by spraying the tobacco as it emerges from the dryer. Alternatively, citric acid may be incorporated in the additives used to form reconstituted tobacco sheet, e.g. the aqueous slurry of tobacco and additives which is cast in sheet form can be adjusted to the desired pH values with citric acid prior to casting.

What is claimed is:

1. A process for removing nicotine from tobacco without substantially removing solubles other than nicotine which comprises forming an aqueous dispersion of particulate nicotine-containing tobacco at a pH of at least about 8.5, and rapidly air convection drying said dispersion at an elevated temperature and at air flow rates such that material temperature does not exceed about 200° F and at least 90% of the initial water content is removed within 2 minutes.

2. The process of claim 1 wherein the initial pH of said dispersion is from about 8.5 to about 9.5.

3. The process of claim 1 wherein the dried tobacco is re-slurried in water and subjected to further rapid drying to further reduce the nicotine content thereof.

4. The process of claim 3 wherein said further drying comprises belt drying the re-slurried tobacco.

5. The process of claim 1 wherein said drying comprises spray drying said aqueous dispersion.

6. The process of claim 1 wherein said drying comprises belt drying said aqueous dispersion.

7. The process of claim 1 wherein said dispersion comprises particulate tobacco having a nicotine content of up to about 7 percent by weight, said dispersion comprises from about 10 to about 50% solids, and said dispersion is formed into a thin film for rapid drying.

8. The process of claim 7 wherein said tobacco comprises at least 0.5 up to 2 percent by weight nicotine, said dispersion comprises from about 10 to about 30 percent solids, said film is deposited upon a belt, and said drying is effected at air temperatures up to 600° F for a period of a few seconds up to one minute.

9. The process of claim 1, further comprising rewetting the dried tobacco product with water, and repeating the dispersion and rapid drying steps to further reduce the nicotine content.

* * * * *